US005863265A

United States Patent [19]

Acton

[11] Patent Number: 5,863,265

[45] Date of Patent: Jan. 26, 1999

[54] FIELD GAME

[76] Inventor: Mark R. Acton, 2149 Sandy Shore Dr., SE., Apt. 203, Grand Rapids, Mich. 49508

[21] Appl. No.: 959,850

[22] Filed: Oct. 29, 1997

[51] Int. Cl.[6] ..... A63B 63/00; A63B 67/00

[52] U.S. Cl. ..... 473/470; 473/476

[58] Field of Search ..... 473/478, 415, 473/470, 471, 476, 410, 411; 273/398, 400, 401

[56] References Cited

U.S. PATENT DOCUMENTS

| | | | |
|---|---|---|---|
| D. 179,002 | 10/1956 | Hoffmeister | D34/5 |
| 620,460 | 2/1899 | Lake | 473/410 |
| 1,441,492 | 1/1923 | Dwight . | |
| 1,583,244 | 5/1926 | Burris et al. . | |
| 1,784,818 | 12/1930 | Bump . | |
| 3,260,525 | 7/1966 | Ortel | 273/77 |
| 3,472,512 | 10/1969 | Berry | 273/83 |
| 3,515,389 | 6/1970 | Wolfe | 273/193 |
| 3,578,325 | 5/1971 | Teas | 273/56 |
| 3,720,410 | 3/1973 | Saytar | 273/67 A |
| 3,923,304 | 12/1975 | Warren | 273/95 R |
| 4,258,923 | 3/1981 | Senoh | 273/398 |
| 4,295,650 | 10/1981 | Keeble | 273/118 R |
| 4,335,881 | 6/1982 | Warehime | 273/348 |
| 4,336,942 | 6/1982 | Warehime | 273/411 |
| 4,373,734 | 2/1983 | Frank | 273/411 |
| 4,441,719 | 4/1984 | Lohr | 273/402 |
| 4,635,943 | 1/1987 | Lumpkin | 273/402 |
| 4,836,542 | 6/1989 | Crawley | 273/55 B |
| 4,842,284 | 6/1989 | Rushing et al. | 273/395 |
| 4,881,737 | 11/1989 | Mullins | 273/80 A |
| 4,949,979 | 8/1990 | Wheatcroft | 273/389 |
| 5,080,375 | 1/1992 | Moosavi | 273/400 |
| 5,088,740 | 2/1992 | Peterson | 273/410 |
| 5,188,358 | 2/1993 | Glass | 273/67 R |
| 5,209,493 | 5/1993 | Chernek | 273/411 |
| 5,303,931 | 4/1994 | Brown | 273/348 |
| 5,308,064 | 5/1994 | Jen | 273/83 |
| 5,395,122 | 3/1995 | Kraemer | 273/400 |
| 5,421,586 | 6/1995 | Amram et al. | 273/400 |
| 5,433,433 | 7/1995 | Armell | 273/26 A |
| 5,516,115 | 5/1996 | McLain | 273/401 |

*Primary Examiner*—William H. Grieb

*Attorney, Agent, or Firm*—Price, Heneveld, Cooper, DeWitt & Litton

[57] ABSTRACT

A field game goal structure which includes a plurality of inner elongate members, at least two of which are connected at an upper end and have spaced apart bottom ends. A plurality of outer elongate members have one end of each outer member attached to one of the bottom ends of each of the inner elongate members. The outer elongate members extending outwardly from a centrally portion of the goal structure. A free end of each of at least two of the outer elongate members are connected. The inner and the outer elongate members in combination define a plurality of intersecting non-vertical, non-horizontal planes.

22 Claims, 3 Drawing Sheets

FIELD GAME

BACKGROUND OF THE INVENTION

The present invention relates to field games, and more particularly to field games in which players attempt to pass objects into a goal to score points.

Athletically oriented games have become a popular means of leisure time activity for many people. The popularity of individual games can be attributed to the game having an appropriate mixture of skill, athletic ability, a fostering of the competitive spirit, and having a set of rules and objectives which make the game easy and fun to play without requiring a large investment on the part of a player. Another factor which facilitates the popularity of a particular game is the ease of the game setup and its adaptability to being played in the physical space available to the players, as well as the portability of the necessary equipment required to play the game.

Athletic action games such as football, soccer, baseball, and basketball generally require a large playing area and multiple players on each team. Applicant is unaware of an action game which is readily adaptable for either indoor or outdoor play and which is scalable as a factor of the available playing area and number of players.

SUMMARY OF THE INVENTION

One aspect of the present invention is a field game goal structure which includes a plurality of inner elongate members, at least two of which are connected at an upper end and have spaced apart bottom ends. A plurality of outer elongate members have one end of each outer member attached to one of the bottom ends of each of the inner elongate members. The outer elongate members extending outwardly from a centrally portion of the goal structure. A free end of each of at least two of the outer elongate members are connected. The inner and the outer elongate members in combination define a plurality of intersecting non-vertical, non-horizontal planes.

Another aspect of the present invention is a field game apparatus comprising a plurality of substantially flat visible field markers defining the boundaries of the playing field, a ball, a bat, and a goal structure. The goal structure comprises a plurality of inner elongate members, at least two of which are connected at an upper end and have spaced apart bottom ends. A plurality of outer elongate members have one end thereof attached to the bottom ends of one of the inner elongate members and extend outwardly from a central portion of the goal structure. A free end of each of at least two of the outer elongate members are connected. The inner and the outer elongate members in combination define a plurality of intersecting non-vertical, non-horizontal planes.

Yet another aspect of the present invention is a method of playing a field game comprising the steps of placing on a playing field a goal structure having a substantially vertical pyramidal shape including a large net attached to a rear portion of the goal, and a small net attached to a front portion of the goal. Placing at least two field markers to define outer boundaries of the playing field. Placing at least one field marker directly in front of the goal. Throwing a ball from the one field marker by a defensive player toward the small net. Striking the ball with an elongate member by an offensive player standing in front of the goal. Scoring defensive points by the defensive player successively hitting the small net. Scoring offensive points by the offensive player striking the thrown ball and propelling the ball at least a predefined distance in front of the goal without the ball being caught by a defensive player.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
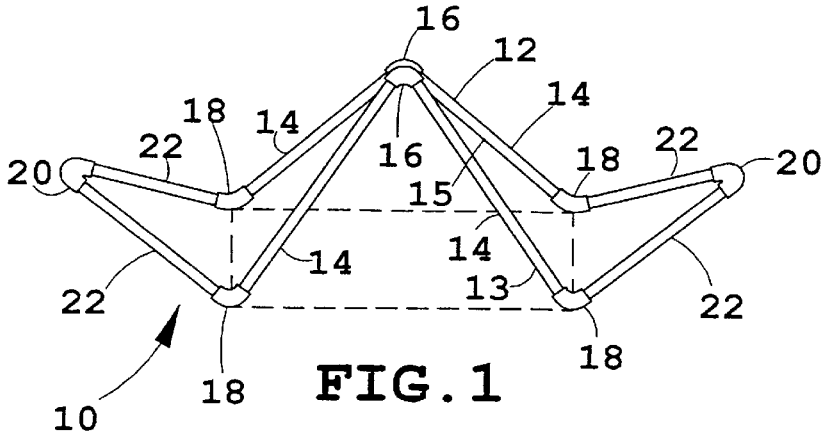
FIG. 1 is a perspective view of a goal embodying the present invention.
Figure 5:
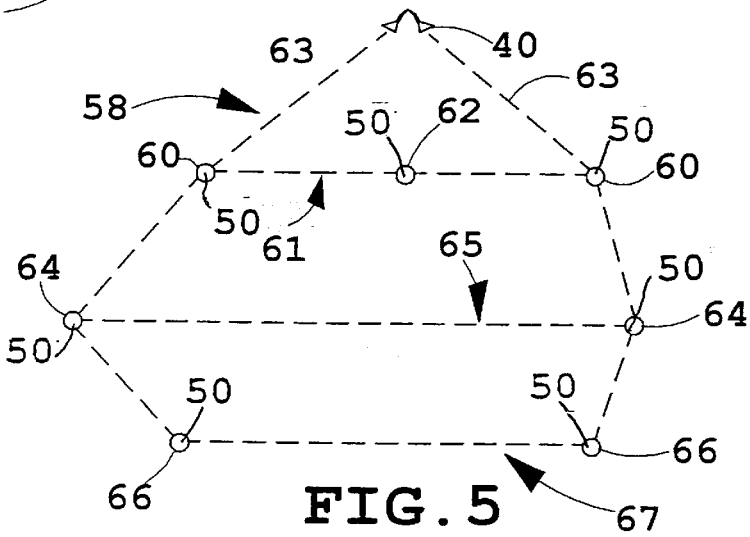
FIG. 5 is a playing field layout utilizing the goal shown in FIG. 3 and the field marker of FIG. 4.

For purposes of description herein, the terms "upper," "lower," "right," "left," "rear," "front," "vertical," "horizontal," and derivatives thereof shall relate to the invention as oriented in FIGS. 1 and 5. However, it is to be understood that the invention may assume various orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Turning to the drawings, FIG. 1 shows a goal 10, which is one of the preferred embodiments of the present invention, and illustrates its various components.

Goal 10 comprises a framework 12 including a plurality of tubes and elbow joints for assembling the uniquely shaped goal 10. Framework 12 comprises four inner elongate members 14 which in the preferred embodiment are resin formed tubes arranged in a front pair 13 and a rear pair 15 wherein tubes 14 forming front pair 13 are joined at upper ends by a first elbow 16, and tubes 14 forming rear pair 15 are joined by a second elbow 16. Elbows 16 are adjoining or in substantially close proximity one to the other such that tubes 14 and elbows 16 are arranged to define a plurality of adjoining triangular planes, each tube 14 lying substantially on the intersection of two adjacent intersecting planes. An elbow 18 is attached to each of the lower ends of tubes 14 wherein elbows 18 have attached at another end thereof outer elongate members 22 which in the preferred embodiment are also resign formed tubes. Two tubes 22 are at a left side of goal 10 and two tubes 22 are at a right side of goal 10. Each of the right and left pairs of tubes 22 at outer ends thereof are adjoined by elbows 20 such that when completely assembled, frame 12, when viewed in front elevation, has a W-shape, and defines a plurality of intersecting triangular planes wherein none of the planes are either horizontally or vertically oriented. In the preferred embodiment, elbows 16, 18, and 20 are 90° elbows and the length of tubes 14 are twice the length of tubes 22.

Figure 2:
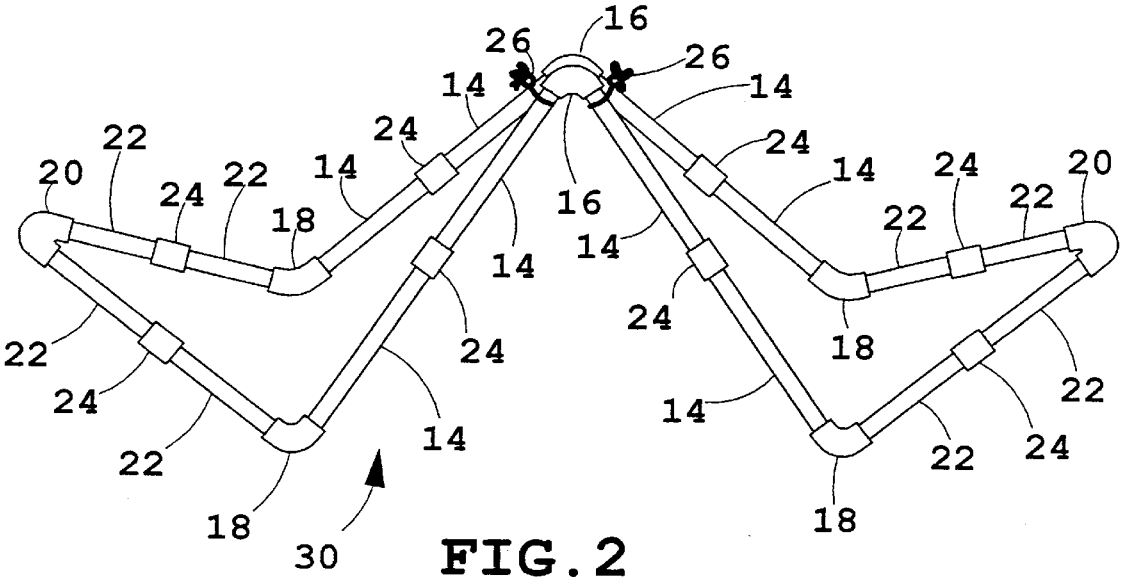
FIG. 2 is a perspective view of the goal shown in FIG. 1 incorporating additional elongate members to increase its size.

FIG. 2 illustrates an alternate goal assembly 30 having the same basic configuration as goal 10 on a larger scale, utilizing the same components as goal 10. Goal 30 utilizes two tubes 14 in axial alignment and joined by a linear joint 24 in place of each tube 14 of goal 10. Further, each tube 22 of goal 10 is replaced by two axially aligned tubes 22 joined by linear joint 24. Upper apex forming elbows 16 are maintained in an adjacent relationship by ties 26 which in the preferred embodiment is a string tied around elbows 16 or around upper ends of tubes 14.

Figure 3:
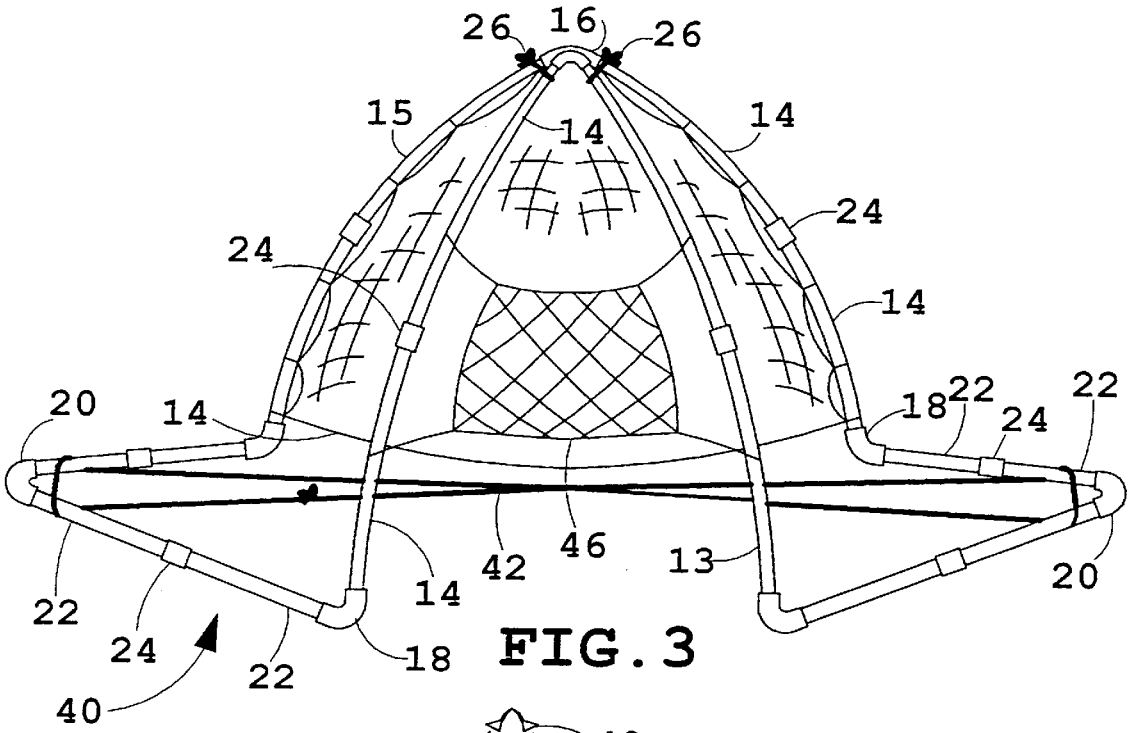
FIG. 3 is a perspective view of the goal shown in FIG. 2 with nets attached thereto.

FIG. 3 illustrates yet another goal 40. Goal 40 comprises goal 30 substantially as described above and further including a biasing member such as string 42 extending between outer ends of goal 40 substantially proximate to elbows 20 which applies an inwardly directed force to pull tubes 22 and elbows 20 toward a central portion of goal 40. String 42 is adjusted to bias tubes 22 horizontally, thus inducing tubes 14 to assume an arcuate convex shape. Ties 26 are again utilized to maintain upper elbows 16 adjacent one to the other. A first net 44 substantially conforming to the area defined by rear pair 15 of tubular members 14 is attached thereto and extends therebetween. Front pair 13 of tubular members 14 also has a second net 46 attached between tubes 14. Net 46 is substantially smaller than the area defined by front pair 13 of tubes 14 and is vertically adjustable along the vertical length of tube pair 13.

Figure 4:
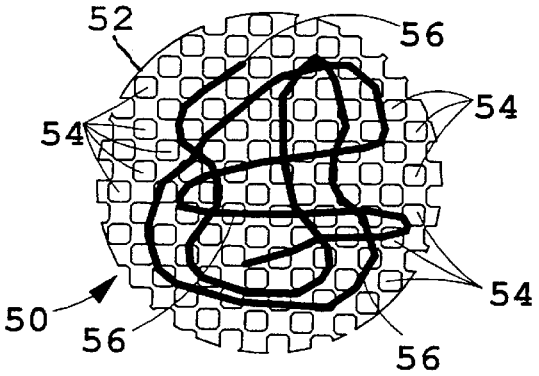
FIG. 4 shows an example of a field marker for use with games incorporating a goal according to the present invention.

FIG. 4 illustrates a field marker 50. Field marker 50 comprises a substantially flat circular member 52 of a resilient material. Member 52 can have a plurality of holes 54 therethrough to permit the protrusion of grass when playing outdoors to prevent shifting or movement of field marker 50. Member 52 can be formed of a brightly colored resilient material so that it is readily visible to the players or alternatively, can have a plurality of brightly colored lines or markings 56 thereon to improve its visibility.

Turning now to FIG. 5 where a general layout for playing a preferred embodiment of a game is shown incorporating the use of goal 40 and field markers 50. The general layout 58 of the preferred embodiment includes one goal 40 and a plurality of field markers 50. Field marker 62 is positioned directly in front of goal 40 at a predetermined distance therefrom and field markers 60 are positioned equally on either side of marker 62 such that goal 40 and markers 60 define an isosceles right triangle with marker 62 at the midpoint of the hypotenuse 61. Intermediate markers 64 are positioned a predefined distance from markers 60 such that line 65 defined by markers 64 is parallel to hypotenuse 61. Outer markers 66 are positioned beyond markers 64 at a predetermined distance such that line 67 interconnecting markers 66 is also parallel to line 65 and hypotenuse 61. Markers 64 and 66 can be laterally positioned along lines 65 and 67 respectively to conform to the constraints of the area in which playing field 58 is located.

The playing field is defined by the interior portion of the polygon defined by goal 40 and markers 60, 64, and 66 and is represented by boundary line 63. The area outside of boundary line 63 represents neutral territory which is substantially out of play. The game may be played by two or more players wherein the object is to score a higher number of points than an opponent. Offensive points are scored by a player standing in front of goal 40 who attempts to hit a ball with an elongated member which may be either a stick or a bat. Such bats and balls are well-known in the game art and do not require further description. The points scored are dependent upon the distance the ball initially travels; scoring points for hitting beyond markers 60; additional points for hitting beyond marker 64; and a maximum number of points for hitting beyond markers 66. A defensive player stands at marker 62 and throws the ball at the small net 46 on goal 40. An offensive player stands in front of goal and attempts to hit the ball beyond markers 60, 64, and 66. The defensive player can score points by successively hitting net 46 without allowing the offensive player standing in front of goal 40 to hit the ball. If the offensive player hits the ball and the ball is caught either in the air or on the ground by the defensive player throwing the ball or by another defensive player prior to the ball hitting the ground, points are deducted from the offensive player's or team's score. The game is complete either when one team has scored a predetermined number of points or by the team having the greatest number of points after the completion of an equal number of alternating offensive and defensive rounds of play.

Figure 6:
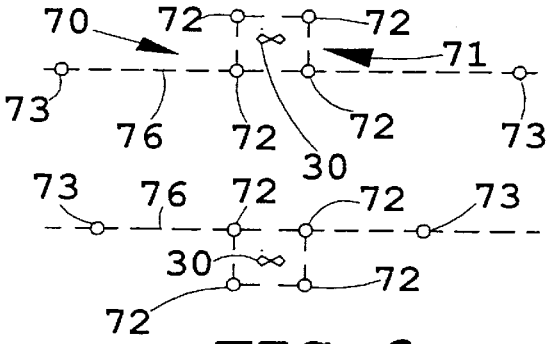
FIG. 6 shows a playing field layout utilizing the goal of FIG. 2 and the field markers of FIG. 4 for use with two-four players.
Figure 7:
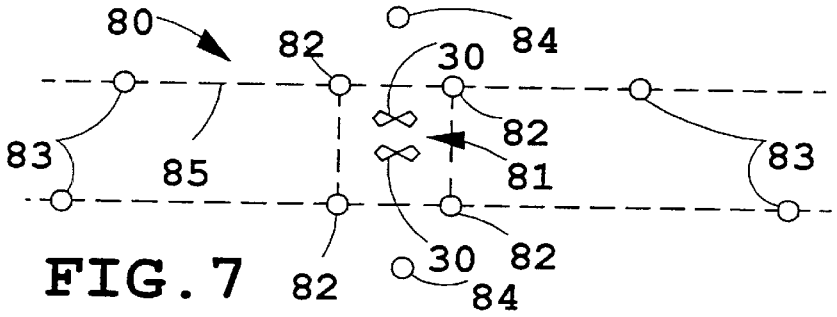
FIG. 7 shows a playing field layout utilizing the goal according to FIG. 2 and the field markers of FIG. 4 for use by six-eight players.
Figure 8:
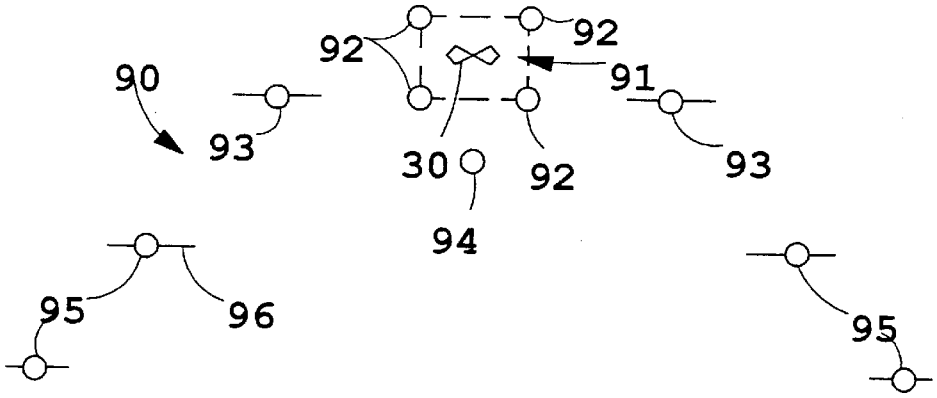
FIG. 8 shows a playing field layout utilizing the goal shown in FIG. 2 and the field markers of FIG. 4 for use by ten or more players.
Figure 8:
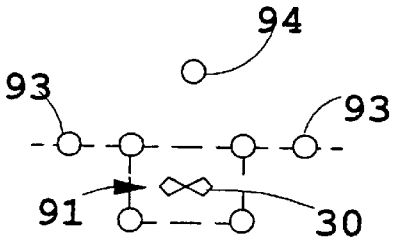

Referring now to FIGS. 6–8, representative playing fields 70, 80, and 90 are illustrated as alternate embodiments for an action game incorporating the use of goal 30 and a throwable flying disk. A goal area or web 71 is defined by placing field markers 50 at reference positions 72, the markers 72 defining a square substantially four times the width of goal 30 on each side, goal 30 being centrally positioned within web area 71. A goal 30 and web 71 are positioned at each end of field 70. Field markers 73 are positioned laterally to the sides of the inner field markers 72 thus defining boundaries 74. Boundaries 74 divide playing field 70 into designated areas having specific rules regarding the permissible contact between players, and manner in which the flying disk is handled and thrown. The object of the game is to throw the disk at the goal 30 and scoring points by striking the frame of the goal. A unique feature of the game associated with the field layout is that individual players wear a removable flag such that when a player having possession of the flying disk has the flag removed by an opposing or defending player results in either a disk possession change or a penalty shot on the goal, the particular consequences being a function of the field area in which the flag is removed. In a penalty shot situation, the offensive and defensive player involved proceed to the opposite team member's goal area and the offensive player in possession of the disk has the option of attempting to score by throwing the disk at either goal. Playing field 70 represents a playing field of limited area which is best utilized when there are only one or two members per team.

FIG. 7 illustrates a somewhat larger alternate embodiment playing field 80 wherein opposing goals 30 are positioned back-to-back and are centrally located in a web 81 defined by field markers 82. Field markers 83 are laterally positioned to the sides of markers 82 again dividing field 80 into a plurality of distinct areas in which different rules govern the acceptable manner of play therein. The object of the game being to score points by throwing the flying disk in a manner to strike the opponent's goal 30. Playing field 80 also incorporates field markers 84 a predefined distance from the front of goals 30 for designating positions for opposing teams to take penalty shots at the goal. Playing field 80 is best optimized for playing with three to four members per team in a manner similar to the game associated with FIG. 6.

FIG. 8 illustrates playing field 90 which is on a still larger scale for playing a game where there are five or more players per team also in like manner as with the game associated with FIGS. 6 and 7. Again, as in playing field 70, each goal 30 is positioned at opposite ends of the playing field within a web 91 defined by field markers 92. Web 91 being substantially a square and markers 92 spaced approximately four times the width of goal 30. Field markers 93 and 95 define and separate the playing field into distinct areas in which different rules govern the appropriate play by the players. Playing field 90 also incorporates markers 94 for designating the position which a team may take when exercising a penalty shot on an opposing team's goal 30.

Figure 9:
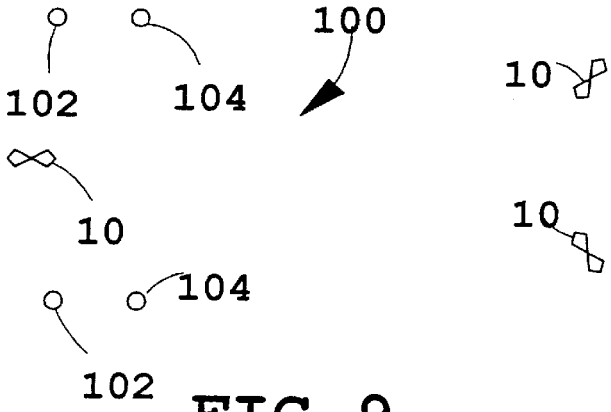
FIG. 9 shows the playing layout for an indoor game using the goal shown in FIG. 1.

Referring now to FIG. 9, another embodiment of a game utilizing a goal according to the embodiment of goal 10 is shown wherein a plurality of goals 10, in this case three, are spaced within playing area 100. The game is played with offensive game elements and separate defensive game elements projected about a course of play by the players, and in a preferred embodiment the game is played with either flying disks or with balls. Each player begins play with either two flying disks or two balls. The following description illustrates play using balls and bats, it will be understood that the flying disk version is similar. One ball is an offensive ball 102, the other is a defensive ball 104. The object of the game is for a player to navigate the offensive ball 102 through the plurality of goals 10 in a predefined order while projecting the defensive ball 104 about the course of play or playing field at the option of the player for the purpose of interfering with the sequential progress of an opponent's offensive element through the plurality of goal structures and the first player completing the designated number of circuits around the course being the winner. Successful passing of ball 102 through goal 10 may be accomplished by passing the ball through the central portion of goal 10 and can be approached from either front to back or from side to side.

Figure 10:
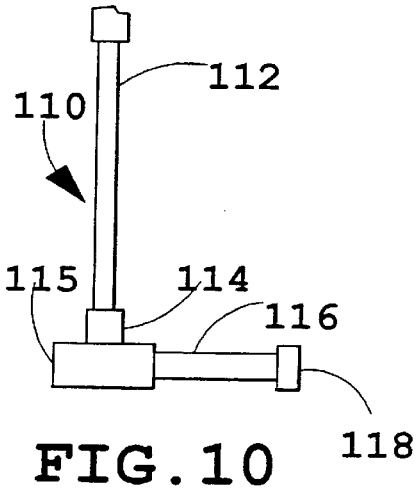
FIG. 10 shows a mallet for use in the game layout shown in FIG. 9.

When the game according to FIG. 9 is played utilizing balls, a mallet 110 as illustrated in FIG. 10 is used. Mallet 110 comprising an elongate tubular handle 112 having at a lower portion thereof a T fitting 114 which has a short tubular section 116 extending from one end of T fitting 114. The other end of tube 116 is terminated with a cap 118. The offensive and defensive balls of the player can be struck and propelled by mallet 110 in a variety of different manners. The mallet is also used to measure distances to an opponent's offensive and defensive balls as measured by small tubular section 116 such that the opponent's ball may be propelled when a player's defensive ball approaches within the distance described by short tubular section 116. The opponent's ball may be propelled by rotating mallet 110 about end 115 and striking the opponent's ball with cap 118.

In the foregoing description, it will be readily appreciated by those skilled in the art that modifications may be made to the invention without departing from the concepts disclosed herein. Such modifications are to be considered as included in the following claims, unless these claims expressly state otherwise.

The invention claimed is:

1. A field game goal structure comprising:

a plurality of inner elongate members, at least two of which are connected at an upper end thereof, and have spaced apart bottom ends;

a plurality of outer elongate members, one end of one of said outer elongate members attached to said bottom end of each of said inner elongate members and extending outwardly from a central portion of said goal structure, wherein a free end of each of at least two of said outer elongate members are connected; and said inner and said outer elongate members in combination defining a plurality of intersecting non-vertical, non-horizontal planes.

2. The field game goal structure of claim 1 wherein said inner and said outer elongate members are tubes.

3. The field game goal structure of claim 2 wherein said inner elongate member has a length substantially twice that of said outer elongate member.

4. The field game goal structure of claim 3 wherein said goal defines in elevation a substantially W-shape.

5. The field game goal structure of claim 4 wherein said elongate members in combination define a plurality of intersecting triangular planes.

6. The field game goal structure of claim 5 wherein said elongate members are joined by elbow fittings.

7. The field game goal structure of claim 1 further including a member biasing said outer elongate members to a substantially horizontal plane and further biasing said inner elongate members into a convex profile.

8. The field game goal structure of claim 7 further including a first net extending between a rear pair of inner elongate members and a second net extending between a front pair of inner elongate members, said first net being substantially larger than said second net.

9. The field game goal structure of claim 8 wherein said inner and said outer elongate members are tubes.

10. The field game goal structure of claim 9 wherein said inner elongate member has a length substantially twice that of said outer elongate member.

11. The field game goal structure of claim 10 wherein said elongate members are joined by elbow fittings.

12. A field game apparatus comprising:

a plurality of substantially flat visible field markers defining the boundaries of a playing field;

a ball;

a bat; and a goal structure comprising:

a plurality of inner elongate members, at least two of which are connected at an upper end thereof, and having spaced apart bottom ends;

a plurality of outer elongate members, one end of one of said outer elongate members attached to said bottom ends of one of said inner elongate members and extending outwardly from a central portion of said goal structure, wherein a free end of each of at least two of said outer elongate members are connected; and said inner and said outer elongate members in combination defining a plurality of intersecting non-vertical, non-horizontal planes.

13. The field game apparatus according to claim 12 wherein said goal structure further includes a member biasing said outer elongate members to a substantially horizontal plane and further biasing said inner elongate members into a convex profile.

14. The field game apparatus according to claim 13 wherein said goal structure further includes a first net extending between a rear pair of inner elongate members and a second net extending between a front pair of inner elongate members, said first net being substantially larger than said second net.

15. The field game apparatus according to claim 14 wherein said inner and said outer elongate members of said goal structure are tubes.

16. The field game apparatus according to claim 15 wherein said inner elongate members of said goal structure have a length substantially twice that of said outer elongate members.

17. The field game apparatus according to claim 16 wherein said elongate members of said goal structure are joined by elbow fittings.

18. A method of playing a field game comprising the steps of:

placing on a playing field a goal structure having a substantially vertical pyramidal shape including a large net attached to a rear portion of the goal, and a small net attached to a front portion of the goal;

placing at least two field markers to define outer boundaries of the playing field;

placing at least one field marker directly in front of the goal;

throwing a ball from the one field marker by a defensive player toward the small net;

striking the ball with an elongate member by an offensive player standing in front of the goal;

deducting offensive points when the defensive player throwing the ball successively hits the small net and when a defensive player catches a struck ball before the ball contacts the ground; and scoring offensive points when the thrown ball misses the goal structure and when the offensive player strikes the thrown ball propelling the ball at least a predefined distance in front of the goal without the ball being caught by a defensive player.

19. An improved method of playing a disk throwing game on a playing field having as an object the scoring of points by striking a goal structure with a thrown flying disk, wherein the improvement comprises: placing a flag on an offensive player prior to beginning play:

removing a flag from an offensive player in possession of the flying disk in a first area of the playing field by a defensive player to cause a possession change of the disk; and removing a flag from an offensive player in possession of the flying disk in a second area of the playing field by a defensive player to cause a penalty shot on a goal.

20. The improved method of playing a disk throwing game according to claim 19 wherein the step of removing a flag from an offensive player in possession of the flying disk in a second area of the playing field further includes the option by the throwing player to strike either goal to score at least one point.

21. The improved method of playing a disk throwing game according to claim 19 further including the step of:

placing on a playing field a goal structure having a substantially vertical pyramidal shape having an apex at an upper end.

22. An improved method of playing a game on a playing field having as an object the first player to complete the navigation of a predetermined pattern of a plurality of goal structures by projecting an offensive element through the plurality of a goal structures in a predetermined sequence, wherein the improvement comprises:

possessing an offensive element and a separate defensive element by each player for projection about the playing field; and projecting the defensive element about the playing field at the option of each player for the purpose of interfering with the sequential progress of an opponent's offensive element through the plurality of goal structures.

* * * * *